US006874795B2

(12) United States Patent
Sung

(10) Patent No.: US 6,874,795 B2
(45) Date of Patent: Apr. 5, 2005

(54) WHEELED SKATE DEVICE

(76) Inventor: Chien-Min Sung, No. 4, Lane 32, Chung-Cheng Road, Tansui, Taipei County (TW)

( * ) Notice: Subject to any disclaimer, the term of this patent is extended or adjusted under 35 U.S.C. 154(b) by 0 days.

(21) Appl. No.: 10/216,108

(22) Filed: Aug. 8, 2002

(65) Prior Publication Data

US 2003/0020244 A1 Jan. 30, 2003

Related U.S. Application Data

(63) Continuation-in-part of application No. 09/832,295, filed on Apr. 10, 2001, now abandoned, which is a continuation of application No. 09/287,462, filed on Apr. 7, 1999, now abandoned.

(51) Int. Cl.[7] ..... A63C 17/04

(52) U.S. Cl. ..... 280/11.223; 280/843; 280/11.26; 280/11.28

(58) Field of Search ..... 280/11.19, 11.204, 280/11.222, 11.225, 11.26, 11.27, 11.28, 11.31, 11.14, 11.226, 11.203, 11.211, 11.206, 11.223

(56) References Cited

U.S. PATENT DOCUMENTS

| | | | | | |
|---|---|---|---|---|---|
| 208,234 | A | | 9/1878 | Gregg | |
| 275,482 | A | * | 4/1883 | Gregg | 280/11.19 |
| 336,600 | A | * | 2/1886 | Tennent | 280/11.19 |
| 1,194,102 | A | * | 8/1916 | Webb | 280/11.19 |
| 1,271,891 | A | | 7/1918 | Gustin | |
| 1,292,813 | A | | 1/1919 | Landgraf | |
| 1,393,813 | A | | 10/1921 | Muck | |
| 1,421,532 | A | | 7/1922 | Muck | |
| 1,616,442 | A | | 2/1927 | Festenburg et al. | |
| 1,632,997 | A | | 6/1927 | Connolly | |
| 1,778,850 | A | | 10/1930 | Duisenberg | |
| 1,811,532 | A | | 6/1931 | Benetatos | |
| 1,854,188 | A | | 4/1932 | Gregory | |
| 2,430,037 | A | * | 11/1947 | Vincent | 280/11.209 |
| 2,474,082 | A | * | 6/1949 | Wutz | 280/11.19 |
| 3,306,623 | A | | 2/1967 | Weitzner | |
| 3,351,353 | A | | 11/1967 | Weitzner | |
| 3,379,454 | A | | 4/1968 | Woodman | |
| 3,936,061 | A | * | 2/1976 | Wada | 280/11.226 |
| 3,963,251 | A | | 6/1976 | Miano | |
| 4,061,348 | A | * | 12/1977 | Carter | 280/11.201 |
| 4,076,263 | A | | 2/1978 | Rand | |
| 4,394,028 | A | | 7/1983 | Wheelwright | |
| 4,417,737 | A | | 11/1983 | Suroff | |
| 4,541,643 | A | | 9/1985 | Pavincic | |
| 4,572,529 | A | | 2/1986 | Thomas | |
| 4,709,937 | A | * | 12/1987 | Lin et al. | 280/11.209 |
| 4,844,491 | A | | 7/1989 | Wheelwright | |
| 5,207,454 | A | | 5/1993 | Blankenburg et al. | |
| 5,409,265 | A | | 4/1995 | Douglass | |
| 5,549,331 | A | | 8/1996 | Yun et al. | |
| 5,709,395 | A | | 1/1998 | Lee | |
| 5,716,074 | A | | 2/1998 | Theodorou | |
| 5,775,717 | A | * | 7/1998 | Bobrowicz | 280/607 |

(Continued)

*Primary Examiner*—Christopher P. Ellis
*Assistant Examiner*—Jeff Restifo
(74) *Attorney, Agent, or Firm*—Thorpe North & Western

(57) ABSTRACT

A wheeled skate device has a pair of large primary wheels coupled to a platform. The primary wheels rotate about primary axes of rotation in both forward and rearward directions. A binding can be disposed on the platform to secure the user's feet. The primary axes are located at a height above the platform or binding. The skate device can have a universal wheel coupled to the platform which rotates about a secondary axis of rotation. The universal wheel also pivots about a vertical pivot axis such that the universal wheel turns with the platform without sliding on the support surface. The wheels cooperatively operate in a travel mode and spinning mode.

25 Claims, 7 Drawing Sheets

U.S. PATENT DOCUMENTS 5,833,348 A * 11/1998 Bailey, Jr. ..... 362/473
5,951,027 A * 9/1999 Oyen et al. ..... 280/11.225
5,951,028 A * 9/1999 Lovitt et al. ..... 280/11.222
6,012,727 A * 1/2000 Chang ..... 280/11.28
6,065,762 A 5/2000 Brelvi
6,217,039 B1 * 4/2001 Iverson et al. ..... 280/11.26
6,293,565 B1 9/2001 Bouchard et al.
6,398,229 B1 * 6/2002 Saylor ..... 280/11.19
6,416,063 B1 * 7/2002 Stillinger et al. ..... 280/11.223
6,443,464 B2 * 9/2002 Lovitt et al. ..... 280/11.233
6,557,861 B2 * 5/2003 Saylor ..... 280/11.19

* cited by examiner

WHEELED SKATE DEVICE

This application is a continuation-in-part of U.S. patent application Ser. No. 09/832,295 filed Apr. 10, 2001 now abandon, which is a continuation of U.S. patent application Ser. No. 09/287,462 filed Apr. 7, 1999 now abandon.

BACKGROUND OF THE INVENTION

1. Field of the Invention

The present invention relates generally to a wheeled skate device. More particularly, the present invention relates to a wheeled skate device with larger primary wheels.

2. Related Art

Conventional roller skates have two pairs of wheels, forward and back, mounted underneath a boot, or other foot platform, in two rows. More modern in-line skates have a plurality of wheels, typically four, mounted underneath the boot in a single row to imitate a blade of an ice skate. Because the wheels are mounted underneath the skate, the wheels must be kept relatively small in order to prevent raising the user's center of gravity, and thus making balance more difficult. Therefore, conventional and modern skates seldom use wheels larger than 6 cm in diameter.

One disadvantage with smaller wheels is that frictional forces are more difficult to overcome. The smaller wheels tend to get caught in irregularities, such as indentations, holes, cracks, roughness, etc., in the ground or support surface on which the wheels are rolling. Even smaller irregularities tend to catch, or drag, the small wheels.

Another disadvantage with the four-wheel design of conventional and modern skates is the difficulty in turning. The turning is made difficult with four wheels simultaneously touching the ground because of the frictional force of the four wheels. In addition, with four wheels located at four corners of the boot, as with conventional skates, or with four wheels located in a single line, as with modern in-line skates, the wheels must slide or drag on the ground or contact surface. The sliding or dragging of wheels consumes energy and the user loses speed when making a turn. In addition, balance is more difficult to maintain during sliding. Maneuverability is particularly difficult when making rapid sharp turns, such as when playing hockey. Other movements available in ice skating, such as spinning, are also prohibited by the frictional contact between the sliding wheels and the ground. Therefore, the skill of the user is often constrained by the limitations in the skate.

Another disadvantage with conventional skates is that they are often rigidly attached to the platform. Thus, impacts or shocks experienced by the wheels from the riding surface are passed through to the user's feet.

SUMMARY OF THE INVENTION

It has been recognized that it would be advantageous to develop a wheeled skate device for enhancing the user's performance and expanding the user's ability to turn and maneuver. In addition, it has been recognized that it would be advantageous to develop a wheeled skate device for reducing frictional losses. In addition, it has been recognized that it would be advantageous to develop a wheeled skate device capable of providing other actions, such as spinning. In addition, it has been recognized that it would be advantageous to develop a wheeled skate device with greater stability and balance.

The invention provides a wheeled skate device with a frame movably disposed over a support surface, such as the ground. The frame includes a platform to receive a foot of a user. A binding can be located on the frame to extend over the foot of the user to secure the foot of the user to the platform. One or more primary and auxiliary wheels, such as a pair of primary wheels, can be rotatably coupled to the frame to roll on the support surface. The primary wheels each advantageously have a primary axis of rotation located at a height above the upper surface of the platform. The large diameter of the wheels reduces friction losses while the high elevation of the axis improves stability.

In accordance with a more detailed aspect of the present invention, the primary axes of rotation of the primary wheels can be located at a height above the binding, and thus above the foot of the user.

In accordance with another more detailed aspect of the present invention, the platform can be tiltable and can have an adjustable angular orientation with respect to the frame. Thus, the platform can be adjusted to suit the user.

In accordance with another more detailed aspect of the present invention, the skate device can include a cushion disposed between the frame and the platform. The cushion can include a wedged shaped cushion with a thinner end and an opposite thicker end. The cushion can soften impacts and/or provide angular adjustment.

In accordance with another more detailed aspect of the present invention, the skate device can include front and rear stops secured to the platform and spaced apart a distance sized to receive the foot of the user therebetween. One or more of the front and rear stops can be adjustably secured to the platform and selectively movable in a longitudinal direction. Similarly, left and right side stops can be secured to the platform and spaced apart a distance sized to receive the foot of the user therebetween. One or more of the left and right side stops being adjustably secured to the platform, and selectively movable in a lateral direction. Thus, the platform can be sized for the user's foot, and the user's foot can be positioned with respect to the frame. Thus, the device can be sized for the user's feet, and the user's feet can be positioned on the frame to suit the user's preferences.

In accordance with another more detailed aspect of the present invention, the skate device can include an axel rotatably coupling each of the primary wheels to the frame. A compressible material can be disposed between the axel and the frame. Thus, the compressible material can cushion the ride, and/or allow the wheels to pivot to assist turning.

In accordance with another more detailed aspect of the present invention, the primary wheels can be adjustably coupled to the frame, and can be vertically adjustable with respect to the frame. The skate device can include lateral attachment supports extending from the frame. Slots can be formed in the lateral attachment supports. Blocks can be movably disposed in the slots with the primary wheels rotatably attached to each block. An adjustable member can be selectively positionable in each slot. Thus, the elevation of the user's foot can be adjusted to suit the user. Compressible members can be disposed in each slot on each side of the block. Again, the compressible members can cushion the ride, and/or allow the wheels to pivot to assist turning.

In accordance with another more detailed aspect of the present invention, the skate device can include a break wheel rotationally coupled to the frame to be selectively engagable with the support surface. A friction member can be coupled to the frame and adjustably engagable with the break wheel to adjustably resist rotation of the break wheel.

In accordance with another more detailed aspect of the present invention, the skate device can include a pair of lateral attachment supports coupled to the frame. Each primary wheel can be rotatably attached to one of the lateral attachment supports. A compressible member can be disposed between each lateral attachment support and the frame. Thus, the lateral attachment supports and the primary wheels are allowed to pivot with respect to the frame to assist in turning.

In accordance with another more detailed aspect of the present invention, the skate device can include a secondary universal wheel rotatably coupled to the frame. The secondary universal wheel can rotate about a secondary axis of rotation that is oriented generally horizontally. In addition, the secondary wheel can further pivot about a generally vertical pivot axis.

In accordance with another more detailed aspect of the present invention, the primary wheels can be configured for cooperatively operating in at least two modes to make rolling contact with the support surface without sliding. The two modes include a travel mode and a spinning mode. In the travel mode, the primary wheels each rotate in a common direction. In the spinning mode, the primary wheels rotate in opposite directions relative to one another. The primary and universal wheels cooperatively operate in the travel and spinning modes such that the primary and universal wheels each rotate in a common direction in the travel mode, and such that the secondary axis of rotation of the universal wheel is oriented traverse to the primary axes of rotation of the primary wheels in the spinning mode.

In accordance with another more detailed aspect of the present invention, the primary wheels can have a common primary axis of rotation and the frame can vertically pivot about the primary axis of rotation between first and second orientations. In the first orientation, the universal wheel is in a non-contacting relationship with the support surface, and the skate device has two points of contact with the support surface defined by the primary wheels. In the second orientation, the universal wheel contacts the support surface, and the skate device has three points of contact with the support surface defined by the primary and universal wheels.

In accordance with another more detailed aspect of the present invention, the frame and platform can be sized to receive both feet of the user.

Additional features and advantages of the invention will be apparent from the detailed description which follows, taken in conjunction with the accompanying drawings, which together illustrate, by way of example, features of the invention.

DETAILED DESCRIPTION

Figure 1:
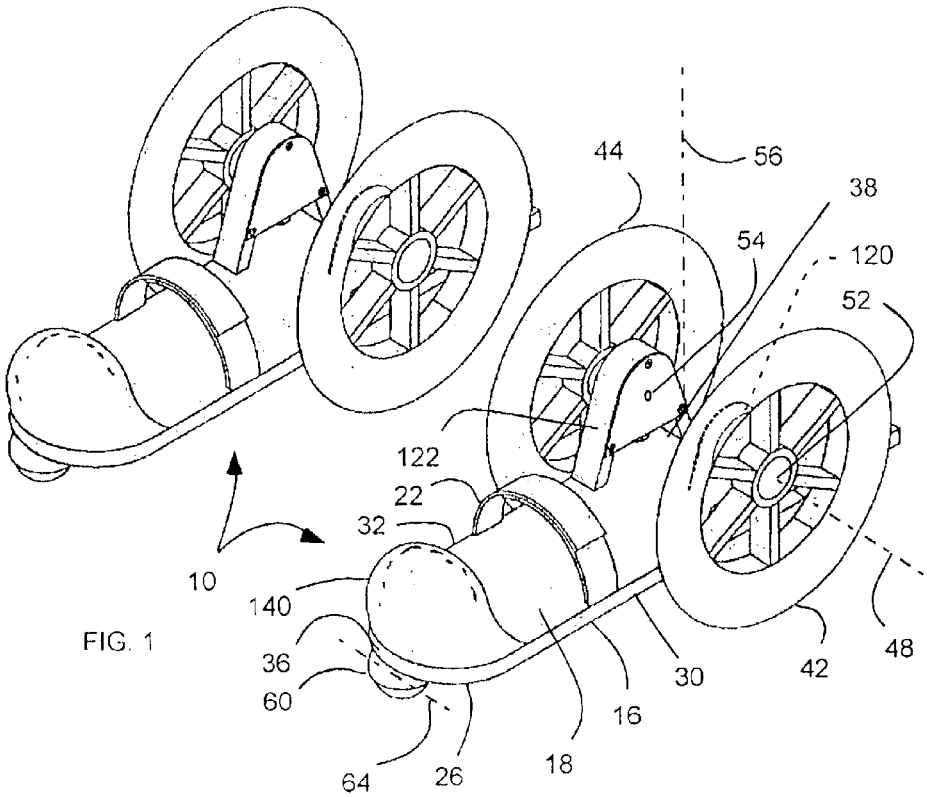
FIG. 1 is a perspective view of a pair of skate devices in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
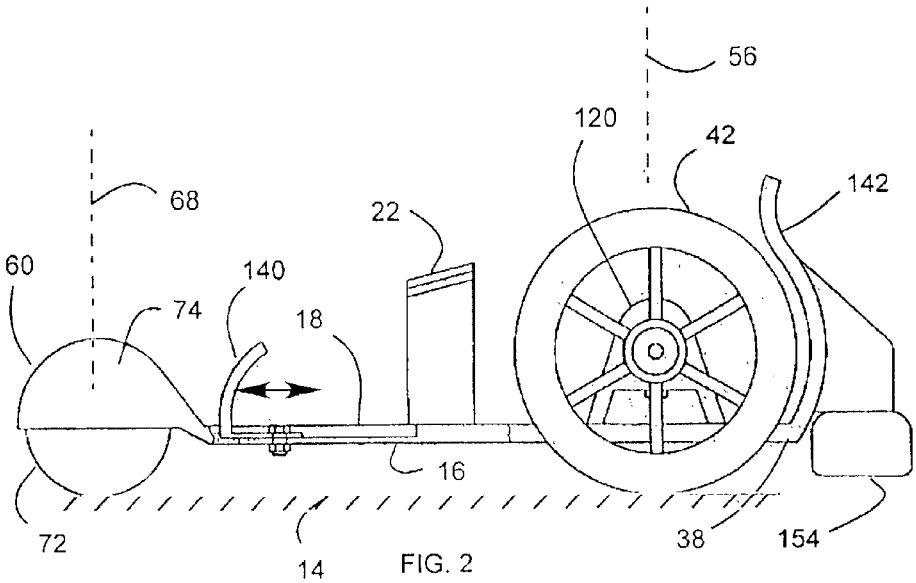
FIG. 2 is a side view, partially broken away, of another skate device in accordance with an embodiment of the present invention.

As illustrated in FIG. 1, a pair of wheeled skate devices, each indicated generally at 10, is shown disposed on the ground or a support surface (indicated at 14 in FIG. 2). The support surface 14 may be a concrete sidewalk or driveway, an asphalt road or street, a wooden roller-skating rink, etc.

The skate device 10 has a frame 16 with a platform 18 to receive and securely hold a user's foot, or other limb, such as a user's knee. The platform 18 may be part of a boot which is sized and shaped to receive the user's foot, or may be configured to receive a boot, as shown. One or more bindings 22 can be attached to the frame 16 or platform 18 that are sized and shaped to fit over the user's foot to secure the user's foot to the platform 18. Again, the platform 18 and binding 22 can be included in a boot. The frame 16 and the platform 18 are movably disposed above the support surface 14, and move over the support surface 14 as the skate device 10 rolls on the support surface. In addition, the frame 16 or platform 18 is disposed over the support surface 14 at a specified height, defining a space between the platform 18 and the support surface 14.

The platform 18 can be generally flat, as shown, and has an outer perimeter 26 which defines the outer edge of the platform, and which can be sized and shaped as the user's foot or shoe. The platform also has opposite lateral sides, including a first left side 30 and a second right side 32 parallel to the general direction of travel, and opposite longitudinal ends, including a forward end 36 and a rearward end 38 along the general direction of travel.

The skate device 10 further includes one or more primary wheels and one or more auxiliary wheels. The auxiliary wheel can be a primary wheel so that the skate device includes a pair of primary wheels, such as a first or left primary wheel 42, and a second or right primary wheel 44, each rotatably coupled to different lateral sides 30 and 32 of the frame 16. Thus, the left primary wheel 42 is rotatably coupled to the left side 30, while the right primary wheel 44 is rotatably coupled to the right side 32. The primary wheels 42 and 44 make rolling contact with the support surface 14 and support or maintain the platform 18 at the specified height above the support surface 14. Alternatively, the skate device can include a primary wheel as described above, and auxiliary wheel with a different diameter and/or a different axle location.

In one aspect, the primary wheels 42 and 44 rotate about a common, primary axis of rotation 48. The wheels preferably are bidirectional, or rotate in both forward and backward directions about the axis of rotation 48. The primary wheels 42 and 44 have axles 52 and 54, which can be co-axial with the primary axis of rotation 48. The primary wheels 42 and 44 may rotate about the axles 52 and 54, or may be fixed to the axles 52 and 54 with the axles 52 and 54 rotating with respect to the frame 16.

In one aspect, the primary wheels 42 and 44 advantageously are relatively large, or have an outer diameter that is greater than the specified height between the frame 16 or platform 18 and support surface 14. In addition, the diameter of the primary wheels 42 and 44 can be greater than the height of the binding 22. One advantage of the large size of the primary wheels 42 and 44 is the reduction in friction between the wheels and the support surface. In addition, the large wheels are less likely to become stuck or caught in irregularities in the support surface. The outer diameter of the wheels may be as large as 30 cm, or even larger.

The primary wheels 42 and 44 can be coupled to the sides 30 and 32 of the platform outside the outer perimeter 26 of the frame 16. Thus, the large size of the primary wheels 42 and 44 does not raise the user's center of gravity, and thus makes balance easier. In addition, locating the primary wheels 42 and 44 outside the outer perimeter 26 may even lower the center of gravity, as discussed more fully below. In one aspect, the primary axis of rotation 48, and the axles 52 and 54, advantageously are disposed at an elevation above the upper surface of the platform 18. Again, the larger wheels and higher position of the axles can lower the user's center of gravity, making balance easier.

The primary wheels 42 and 44, or the axles 52 and 54 and primary axis of rotation 48, may be located at, or on a substantial vertical line from, a center of gravity of the user, indicated by line 56. Thus, the user may balance only on the primary wheels, and travel and/or spin on only the two primary wheels.

The skate device 10 may further include a secondary or universal wheel 60 rotatably coupled at one end of the platform 18. In one aspect, the primary wheels 42 and 44 are located closer to the rear end 38 of the frame 16 or platform 18 than to the front end 36, while the secondary or universal wheel 60 is located closer to the front end 36 than to the rear end 38. The secondary or universal wheel 60 can have an outer diameter less than the specified height and can be disposed under the frame 16 or platform 18, or within the outer perimeter 26 of the frame 16. Thus, the secondary or universal wheel 60 does not protrude from the platform 18 to create a skate which is longer than necessary, and which may interfere with a mating skate or other structures. Alternatively, the secondary wheel 60 can be located in front of the frame 16 or platform 18, and thus can have diameter larger than the elevation of the frame, as shown in FIG. 2.

The secondary or universal wheel 60 rotates about a secondary axis of rotation, indicated at 64. The secondary axis of rotation 64 preferably is located between the frame 16 and the support surface 14 such that the secondary wheel 60 does not protrude from the frame 16. In addition, the secondary axis of rotation 64 is oriented generally horizontally, or is disposed in a generally horizontal plane parallel with the support surface 14, and/or the frame 16.

The secondary or universal wheel 60 also advantageously pivots about a generally vertical pivot axis, indicated at 68. The secondary wheel 60 may turn, or pivot, as the skate device 10 turns. Thus, the skate device 10, or frame 16, may turn without any of the wheels 42, 44 or 60 sliding on the support surface 14. The secondary or universal wheel 60 can pivot in either direction, left or right, so that the skate may turn, or even spin, in either direction. In addition, the secondary wheel 60 preferably freely pivots about the pivot axis 68, or pivots without hindrance, so that the skate device 10 may be easily turned.

The primary wheels 42 and 44, and the secondary wheel 60, operate cooperatively to roll on the contact surface 14 without sliding. By rolling, rather than sliding, friction between the wheels 42, 44 and 60 and support surface 14 is reduced. In addition, the wheels 42, 44 and 60 operate in at least two modes, including a travel mode and a spinning mode. In the travel mode, all of the wheels 42, 44 and 60 rotate in a common direction, such as forward or backward, and the frame 16 is horizontally displaced. In addition, the primary and secondary axes of rotation 48 and 64 are parallel. In the spinning mode, the primary wheels 42 and 44 rotate in opposite directions relative to one another. For example, the left wheel 42 may rotate in a forward direction, while the right wheel 44 may rotate in a rearward direction. The secondary wheel 60 rotates about the secondary axis of rotation 64, which is oriented traverse to, or intersects, the primary axis 48. Thus, the secondary wheel 60 turns or pivots about the vertical pivot axis 68 so that the secondary wheel 60 rolls, rather than slides, and may travel around the primary wheels about a vertical axis. In the spinning mode, the frame 16 pivots about a vertical axis, and may pivot about the vertical line from the center of gravity 56. The secondary wheel 60 can turn to travel in the direction of rotation. Thus, the user may engage in spinning and other skating maneuvers previously unattainable with prior art skates. This represents a significant advantage over prior art skates in which the wheels do not turn in the direction of the turn, and thus slide on the ground.

As stated above, the primary wheels 42 and 44 can rotate about the common primary axis of rotation 48. In addition, the platform advantageously can vertically pivot about the primary axis 48 between first and second orientations. In the first orientation the secondary wheel 60 is in a non-contacting relationship with the support surface 14, or is suspended above the support surface. Thus, the skate device 10 has two points of contact with the support surface 14 at a given time defined by the two primary wheels 42 and 44. The first orientation may be used for travel, with only the primary wheels rolling on the support surface and the user balancing on the primary axis. The first orientation may also be used in the spinning mode because the skate device is easier to turn with only two points of contact. With only two points of contact, the skate device has reduced frictional losses and is easier to turn. Thus, the secondary wheel 60 may be used only intermittently.

In the second orientation, the secondary wheel 60 is in rolling contact with the support surface 14. Thus, the skate device 10 has three points of contact with the support surface 14 at a given time defined by the two primary wheels 42 and 44 and the single secondary wheel 60. The second orientation may be used to help maintain the user's balance, at slower speeds, etc. Thus, the user may travel by balancing on only the primary wheels, or may travel resting on all three wheels. It is of course understood that all three wheels may be configured to contact the ground continuously, and that two or more secondary wheels may be provided resulting in four or more points of contact.

The secondary or universal wheel 60 can include a spherical or substantially spherical ball 72 coupled to the frame 16 by a coupling member 74. The coupling member 74 can be secured to the frame 16, and defines a semi-spherical cavity therein and a circular opening in the lower side of the coupling member and extending into the cavity. Thus, the cavity and opening of the coupling member face downwardly, or towards the support surface 14. The spherical ball 72 is rotatably disposed in the semi-spherical cavity and a portion of the ball 72 protrudes from the cavity and opening to contact the support surface 14. In addition, a plurality of bearings may be disposed in the cavity between the coupling member 74 and the ball 72 to reduce friction. Alternatively, any low friction surfaces or materials may be used. The semi-spherical cavity allows the spherical ball 72 to rotate about the axis of rotation 64, and to pivot about the pivot axis 68.

Alternatively, the secondary wheel 60 can include a pivotal coupler pivotally and rotatably coupling a wheel to the frame 16. The pivotal coupler can include an arm with a first end and a second end. The wheel is rotatably coupled to the first end of the arm. The pivotal coupler can also include a pivot base attached to the frame. The second end of the arm is pivotally coupled to the pivot base. Thus, the arm and the wheel pivot with respect to the pivot base about the pivot axis 68. The arm can be coupled to the pivot base and the wheel at an angle with respect to the vertical. Thus, as the frame 16 is turned, the arm and wheel tend to pivot about the pivot axis 68 so the wheel rolls in the direction of the turn. Therefore, the wheel maintains rolling contact with the support surface 14 without sliding.

As indicated above, the primary axis of rotation 48 is preferably located at a height above the upper surface of the platform 18. By locating the axis of rotation 48 above the platform 18, the platform 18 is maintained closer to the support surface 14, the center of gravity of the user is kept lower, and thus, balance is easier to maintain. In addition, by locating the axis of rotation 48 higher, and locating the wheels 42 and 44 outside the outer perimeter 26 of the platform 18, larger wheels 42 and 44 may be used, or the diameter of the wheels 42 and 44 may be increased. Larger wheels help reduce friction and decrease the likelihood of the wheels being caught on irregularities in the support surface.

In addition, the size of the primary wheels 42 and 44 can be increased, and the axis of rotation 48 can be raised, to further lower the center of gravity and/or to increase stability. For example, the axis of rotation 48 can be position above the user's foot, or above the binding 22. The primary wheels 42 and 44, or axles 52 and 54, can be coupled to lateral attachment supports 120 and 122, respectively, which are attached to, and extend upwardly from, the frame 16. Thus, the lateral attachment supports 120 and 122 and the frame 16 form a U-shaped member (see FIGS. 8–10) for supporting the wheels 42 and 44.

Figure 3:
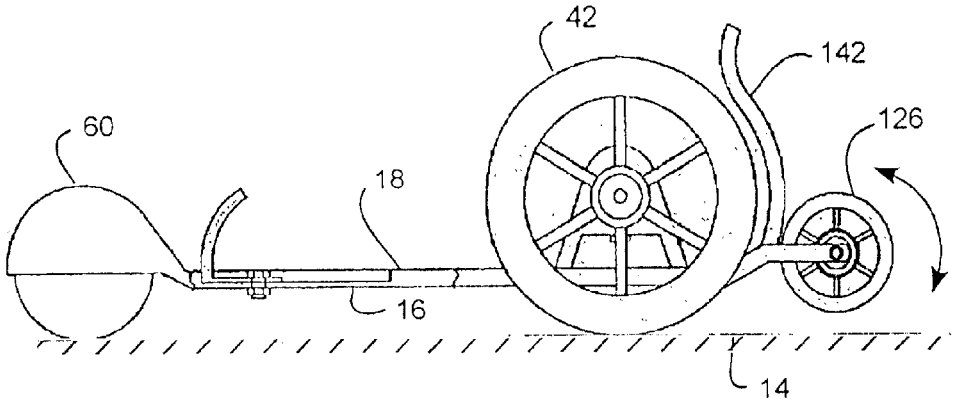
FIG. 3 is a side view, partially broken away, of another skate device in accordance with an embodiment of the present invention.
Figure 11:
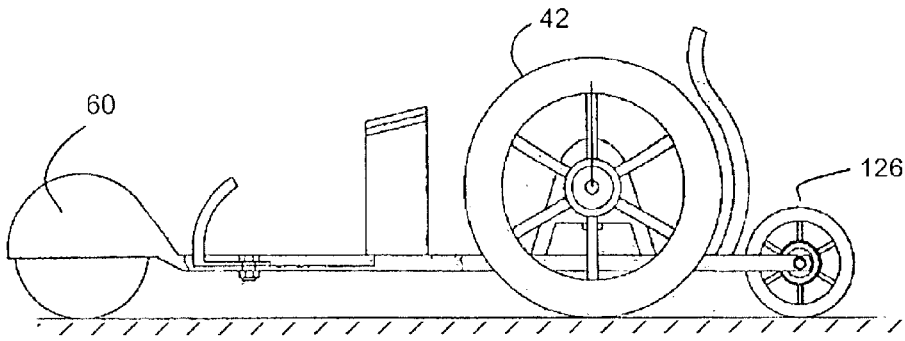
FIG. 11 is a side view of another skate device in accordance with the present invention.

As illustrated in FIG. 1, and as described above, the secondary wheel 60 may be located at the front end 36 of the frame 16, while the primary wheels 42 and 44 are located at the center of gravity 56 and closer to the second end 38. The wheels 42, 44 and 60 may be located and arranged to suit the particular needs of the user. For example, the secondary wheel alternatively may be located at the rear end of the frame, while the primary wheels may be located more forwardly. Having the primary wheels positioned rearward may be more comfortable for users who prefer to lean forward to rest on all three wheels, while having the primary wheels forwardly may be more comfortable for users who prefer to lean backward to rest on all three wheels. The skate device also can include a second secondary wheel 126 (FIG. 3) located at the rear end 38 with the first secondary wheel 60 located at the front end 36. Such a configuration may be useful to help maintain balance in either direction. The first and second secondary wheels 60 and 126 can be positioned so that only one of the two secondary wheels contacts the surface, as shown in FIG. 3, so that the user can selectively pivot back and forth onto either secondary wheel. Alternatively, the first and second secondary wheels can be configured to contact the surface at the same time, as shown in FIG. 11.

As described above, the primary wheels 42 and 44 can share a common primary axis of rotation 48. Alternatively, the primary wheel and the auxiliary wheel can have different axes of rotation positioned at different horizontal and/or vertical locations. For example, the axes of rotation can be parallel, but spaced at different locations along the length of the frame. As another example, the axes of rotation can be spaced at different elevations on the respective attachment portion. Spacing the wheels at different locations may make balance easier for the user. For example, rather than balancing along a single axis, the user may balance along two axes. In addition, the primary and auxiliary wheels can have different outer diameters to accommodate the different locations of the axes. The different diameters may provide different turning characteristics.

Figure 4:
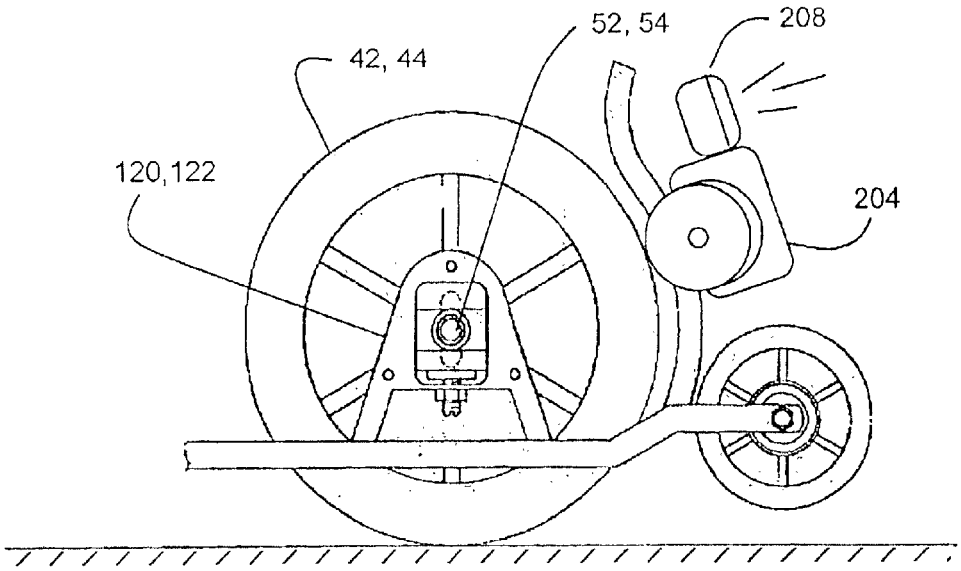
FIG. 4 is a partial side view of the skate device of FIG. 3.
Figure 5:
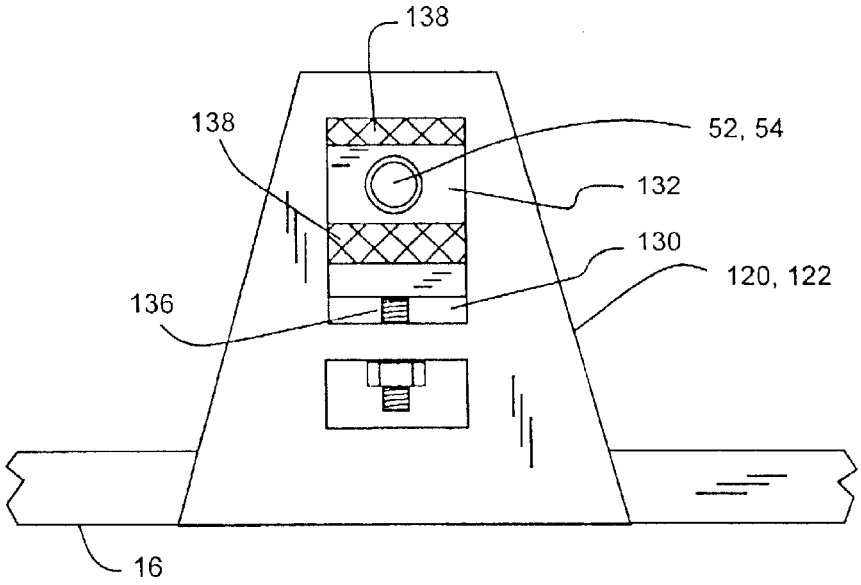
FIG. 5 is a partial side view of the skate devices of FIGS. 1–3.

Referring to FIGS. 4 and 5, the primary wheels 42 and 44 can be adjustably coupled to the frame 16. The primary wheels 42 and 44 can be vertically adjustable along the lateral attachment supports 120 and 122. Thus, the frame 16 can be vertically adjustable with respect to the wheels 42 and 44, and the elevation or height of the frame 16 can be adjusted to suit the user's needs or desires. A slot 130 can be formed in each of the lateral attachment supports 120 and 122. A block 132 can be movably disposed in the slot 130. The block 132 can be contained in the slot by forming a cavity in the lateral attachment supports 120 and 122 sized to receive the block, but with an opening in a wall thereof smaller than the block to prevent the block from passing through the opening. A plate can close off the cavity opposite the opening. The wheels 42 and 44, or their axles 52 and 54, can be attached to the block 132 so that the wheels are movable with the blocks with respect to the vertical portions. Bearings can be disposed between the axles and blocks to reduce friction. An adjustable member 136 can be selectively positionable in each slot 130 and engagable with the block 132 to selectively or adjustably position the block. The adjustable member 136 can include a threaded member threadably engaging a wall of the slot such that turning the threaded member advances and retracts the threaded member in the slot. In addition, compressible members 138, such as rubber pads or blocks, can be disposed between the block 132 and the wall of the slot or the adjustable member 136. The compressible members 138 can be formed of, or can include, a flexible and resilient material, such as rubber. The compressible members 138 can provide some cushioning or shock absorption to the device 10. In addition, the compressible member 138 can allow the axles and wheels to pivot with respect to the frame which can assist in turning.

Figure 6:
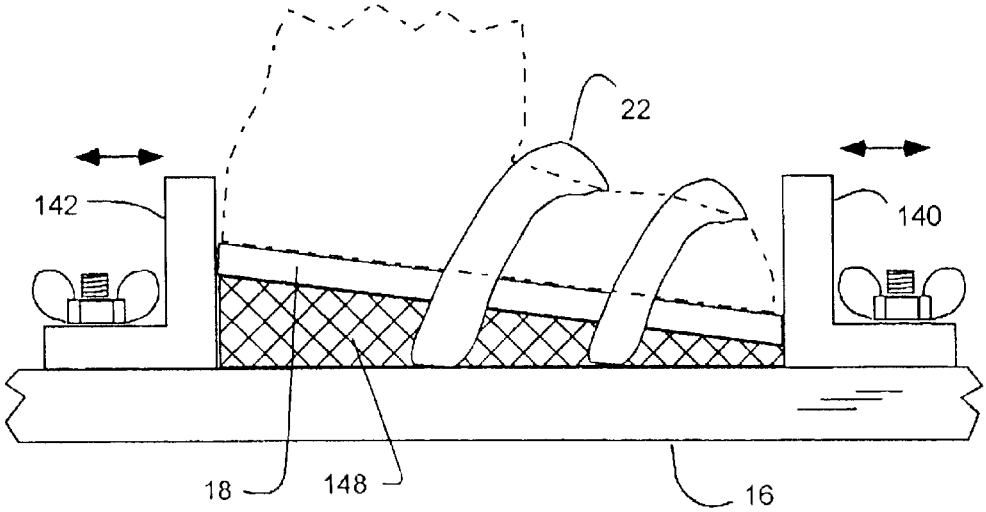
FIG. 6 is a partial side view of the skate devices of FIGS. 1–3.

Referring to FIGS. 1 and 6, the platform 18 can be adjustable with respect to the frame 16 to meet the needs or desires of the user. Front and rear stops 140 and 142 can be adjustably secured to the platform 18 to receive the user's foot therebetween. The front and rear stops 140 and 142 can be selectively moved in a longitudinal direction. Thus, the front and rear stops can be adjusted to fit the size of the user's foot, and to position the user's foot with respect to the frame 16 for comfort or riding style. The stops can include a generally vertical portion to abut to the user's foot, and a generally horizontal portion to abut to the frame. An adjustable fastener, such as a threaded fastener, can extend through the frame 16 and through the horizontal portion of the stops. It will be appreciated that a slot can be formed either in the stops, the frame, or both, to allow the stops to be selectively positioned. The adjustable fastener can include a wing nut so that the user can quickly adjust the stops. Similarly, left and right side stops 144 and 146 (FIG. 8) can be adjustably secured to the platform.

In addition, the platform 18 can be vertically adjustable with respect to the frame 16. A spacer or block 148 can be removably positioned between the frame 16 and the platform 18 to vertically adjust the platform 18. Furthermore, the platform 18 can be selectively oriented or angularly adjustable with respect to the frame 16. The spacer of block 148 can be wedge shaped or have upper and lower surfaces oriented at an acute angle with respect to one another so that the platform 18 can be disposed at a desired angle. Thus, the user can configure the platform so that the user can lean forwardly or backwardly.

A cushion or cushion member 148 also can be disposed between the platform 18 and the frame 16 to provide a cushion for the user's feet. The cushion 148 can be formed of a flexible or compressible material, such as foam. The cushion 148 can be configured with different thickness, such as thicker at the heel, to account for pressure points or the weight of the user.

Figure 8:
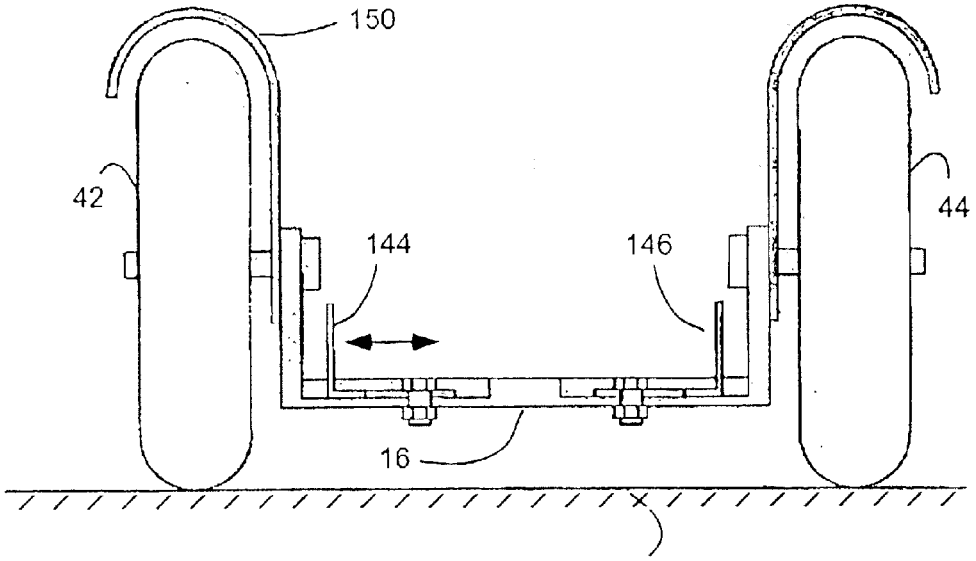
FIG. 8 is an end view, partially broken away, of another skate device in accordance with an embodiment of the present invention.

Referring to FIG. 8, the skate device 10 also can include wheel covers 150 disposed over the wheels 42 and 44 to prevent the wheels 42 and 44 from spraying water and/or rocks. In addition, the wheel covers 150 also prevent adjacent wheels, such as the inside wheels of a pair of skates, from abutting one another.

Figure 7:
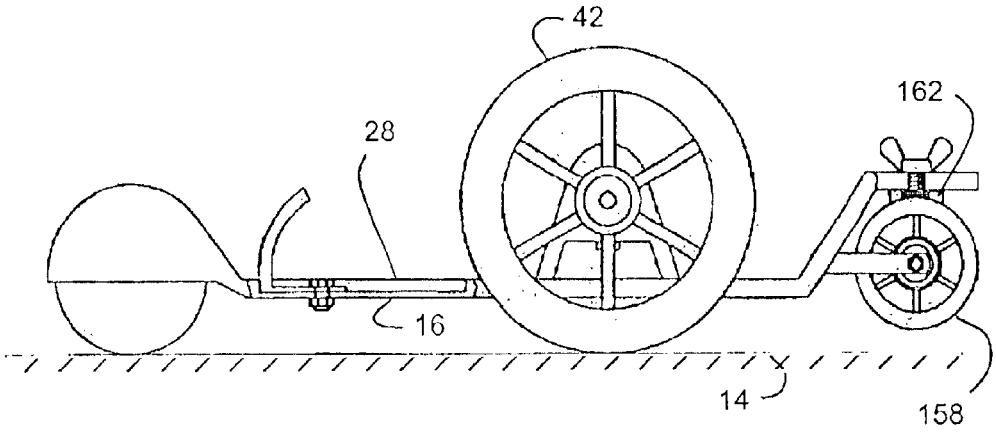
FIG. 7 is a side view, partially broken away, of another skate device in accordance with an embodiment of the present invention.

Referring to FIGS. 2 and 7, the skate device 10 also may have a brake member attached to the rear end 38 of the frame 16. The brake member can be pivoted into contact with the ground 14 by the user leaning backwards. The brake member can include a brake pad 154 formed of a high friction material, such as rubber, to drag along the ground as the user brakes. Alternatively, the brake member can include a friction or brake wheel 158. A friction member 162 can be coupled to the frame 16 and can engage or bear against the break wheel 158 to resist its rotation. The friction member 162 can be adjustable to adjust the amount of friction. For example, a threaded member can be secured to the frame such that rotating the threaded member advances or retracts the friction member 162 from the break wheel.

Figure 9:
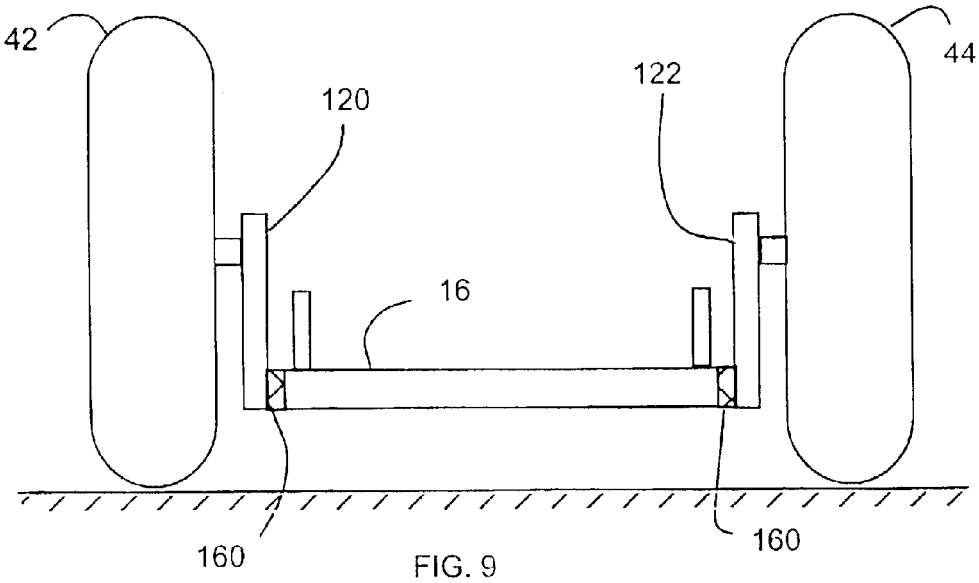
FIG. 9 is a schematic end view of another skate device in accordance with an embodiment of the present invention.
Figure 10:
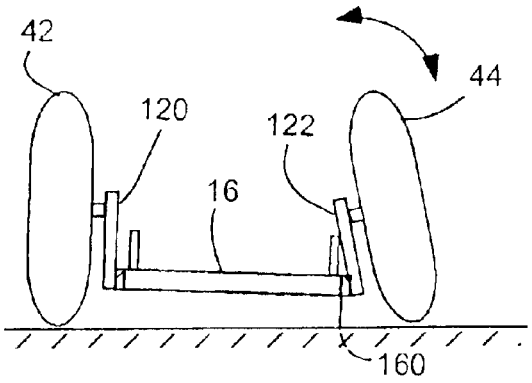
FIG. 10 is a schematic end view of the skate device of FIG. 9.

Referring to FIGS. 9 and 10, the lateral attachment supports 120 and 122 can be flexibly coupled to the frame 16 so that the lateral attachment supports 120 and 122, and thus the primary wheels 42 and 44, can flex or pivot with respect to the frame 16. Compressible members 160 can be secured between the lateral attachment supports 120 and 122 and the frame 16 to allow the attachment portions to pivot. For example, the lateral attachment support 122 and primary wheel 44 can pivot inwardly under the weight of the user or as the skate device 10 turns. It is believed that such flexibility resists jarring during use, and provides stability.

Referring to FIG. 11, all the wheels 42, 44, 60 and 126 can be configured to contact the support surface 14 at once.

Figure 12:
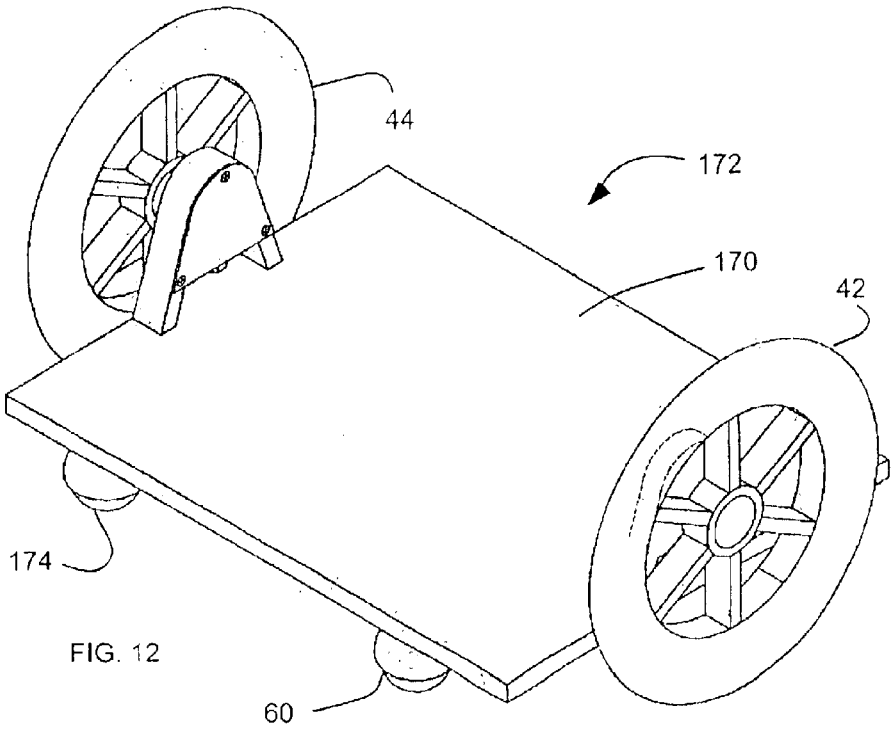
FIG. 12 is a perspective view of another skate device in accordance with the present invention.

Referring to FIG. 12, the platform 170 can be configured or sized to receive both of the user's feet in a single skate device 172. (The bindings and stops have been removed in FIG. 12.) Thus, the platform 170 can have a wider width to accommodate two feet. In addition, a pair of secondary wheels 60 and 174 can be provided. The configuration of the platform 170 to receive both of the user's feet can provide a different and unique riding experience.

Figure 13:
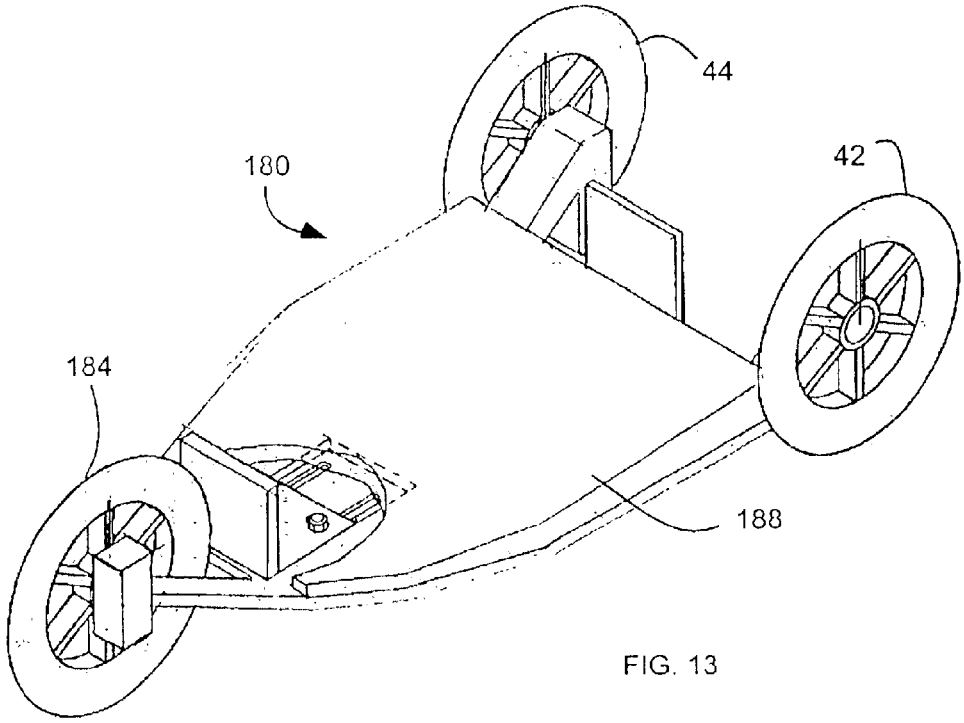
FIG. 13 is a perspective view of another skate device in accordance with the present invention.

Referring to FIG. 13, another skate device 180 also can be configured to receive both of the user's feet. In addition, a larger wheel 184 can be provided at the front of the frame 188 that is similar in size and configuration to the primary wheels 42 and 44 provided at the rear of the frame. The wheels can be attached as shown in FIG. 5. Thus, the compressible members 138 allow the axles or wheels to pivot with respect to the frame. The user can turn the skate device 180 by leaning, causing the frame to pivot the wheels. In addition, the vertical attachment portions can be flexible coupled to the frame, as in FIGS. 9 and 10, to allow the wheels to pivot with respect to the frame, again allowing the user to turn by leaning.

Figure 14:
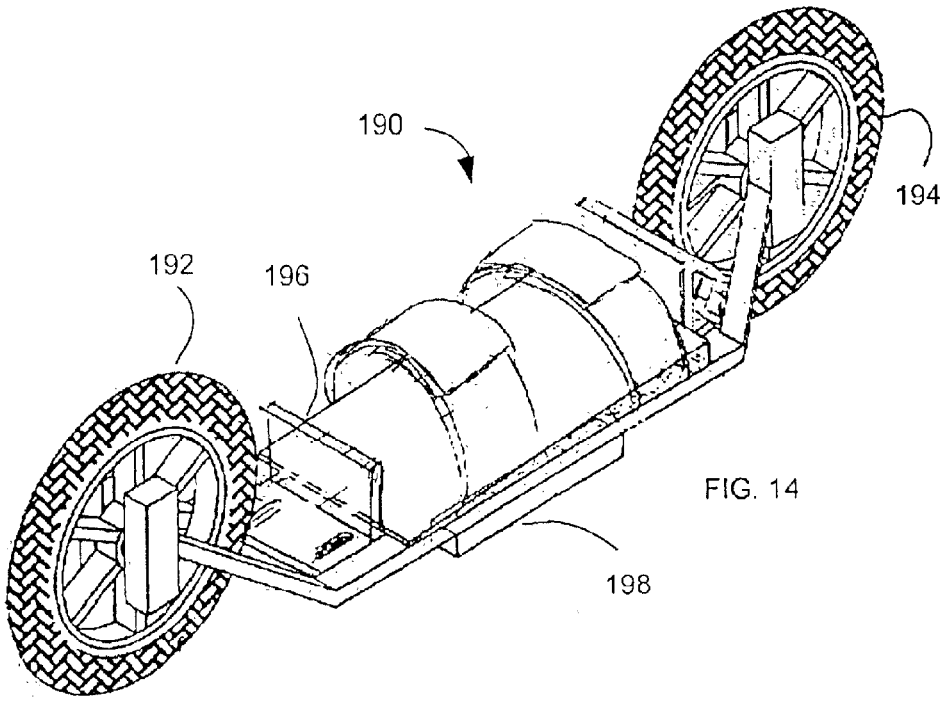
FIG. 14 is a perspective view of another skate device in accordance with the present invention.

Referring to FIG. 14, another skate device 190 can have front and rear wheels 192 and 194 similar to the primary wheels described above, and attached to the frame 196 as shown in FIG. 5. Again, the skate device 190 can be turned by pivoting the frame 196, causing the axles or wheels to pivot. Break pads 198 can be disposed on the underside of the frame 196 to engage the support surface 14 when the platform 196 is tilted inwardly or outwardly.

Referring to FIG. 4, an electrical generator 204 can be coupled to the frame and can operatively engage a primary wheel 42. The electrical generator 204 can include a generator wheel that contacts the primary wheel 42 so that the generator wheel rotates as the primary wheel rolls on the ground. The generator wheel can turn a coil with respect to a magnet in the electrical generator. The electrical generator 204 can generate electricity. One or more lights 208 can be disposed on the skate device, and electrically coupled to the electrical generator. The light can provide a visual indicator for safety. The larger primary wheels are more capable of providing a larger torque.

In addition, the skate device can be configured to be readily disassembled for transport or storage. For example, the primary wheels can be removably coupled to the frame, such as with hand operated fasteners, like wing nuts, etc. Thus, the primary wheels can be removed to reduce the size of the skate device.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. A wheeled skate device comprising:

a) a frame configured to be movably disposed over a support surface, and having a platform with an upper surface configured to receive a foot of a user thereon;

b) a pair of primary wheels, rotatably coupled to the frame, configured to roll on the support surface;

c) the pair of primary wheels having a primary axis of rotation located at a height above the upper surface of the platform;

d) an auxiliary wheel, rotatably coupled to the frame, configured to roll on the support surface;

e) a pair of lateral attachment supports, coupled to opposite lateral sides of the frame, the pair of lateral attachment supports being separate and independent with respect to one another, the pair of primary wheels being rotatably attached to the pair of lateral attachment supports; and f) compressible members, each disposed between the pair of lateral attachment supports and the frame, to allow the pair of lateral attachment supports, and thus the pair of primary wheels, to pivot independently with respect to each other and the frame.

2. A device in accordance with claim 1, further comprising:

at least one binding, coupled to the frame or the platform, sized and shaped to extend over the foot of the user to secure the foot of the user to the platform.

3. A device in accordance with claim 2, wherein the primary axis of rotation of the pair of primary wheels is located at a height above the binding, and thus above the foot of the user.

4. A device in accordance with claim 1, wherein the platform is tiltable with respect to the frame, and wherein an angular orientation of the platform is adjustable.

5. A device in accordance with claim 1, further comprising:

a cushion, disposed between the frame and the platform.

6. A device in accordance with claim 5, wherein the cushion includes a wedged shaped cushion with a thinner end and an opposite thicker end.

7. A device in accordance with claim 1, further comprising:

at least one front or rear stop, secured to a front or a rear of the platform.

8. A device in accordance with claim 1, further comprising:

at least one adjustable front or rear stop, secured to a front or a rear of the platform; and the at least one adjustable front or rear stop being adjustably secured to the platform, and selectively movable in a longitudinal direction.

9. A device in accordance with claim 1, further comprising:

at least one adjustable left or right side stop, secured to a side of the platform; and the at least one adjustable left or right side stop being adjustably secured to the platform, and selectively movable in a lateral direction.

10. A device in accordance with claim 1, further comprising:

at least one axle, rotatably coupling the pair of primary wheels to the frame;

a compressible material, disposed between the axle and the frame.

11. A device in accordance with claim 1, wherein the pair of primary wheels are adjustably coupled to the frame and are vertically adjustable with respect to the frame.

12. A device in accordance with claim 1, further comprising:

a slot, formed in each of the lateral attachment supports;

a block, movably disposed in each slot, each of the primary wheels being rotatably attached to the block.

13. A device in accordance with claim 12, further comprising:

at least one compressible member, disposed in the slot adjacent the block.

14. A device in accordance with claim 12, further comprising:

an adjustable member, selectively positioning the block.

15. A device in accordance with claim 1, further comprising:

a) a brake wheel, rotationally coupled to the frame, configured to be selectively engagable with the support surface; and b) a friction member, coupled to the frame and adjustably engagable with the break wheel, to adjustably resist rotation of the break wheel.

16. A device in accordance with claim 1, further comprising:

a universal wheel, rotatably coupled to the frame, rotating about a secondary axis of rotation which is oriented generally horizontally, the universal wheel further pivoting about a generally vertical pivot axis.

17. A device in accordance with claim 16, wherein:

a) the primary and auxiliary wheels are configured for cooperatively operating in at least two modes to make rolling contact with the support surface without sliding, the two modes including (i) a travel mode in which the primary and auxiliary wheels each rotate in a common direction, and (ii) a spinning mode in which the primary and auxiliary wheels rotate in opposite directions relative to one another; and b) the primary, auxiliary and universal wheels cooperatively operate in the travel and spinning modes, such that the primary, auxiliary and universal wheels each rotate in a common direction in the travel mode, and such that the secondary axis of rotation of the secondary wheel is oriented traverse to the primary axis of rotation of the primary wheel in the spinning mode.

18. A device in accordance with claim 16, wherein:

a) the primary and auxiliary wheels have a common primary axis of rotation;

b) the platform vertically pivots about the primary axis of rotation between:

1) a first orientation in which the universal wheel is in a non-contacting relationship with the support surface, and such that the skate device has two points of contact with the support surface defined by the primary and auxiliary wheels, and 2) a second orientation in which the universal wheel contacts the support surface, and such that the skate device has three points of contact with the support surface defined by the primary, auxiliary and universal wheels.

19. A device in accordance with claim 1, wherein the platform is sized to receive both feet of the user.

20. A device in accordance with claim 1, wherein the primary wheel is disposed at a front or a rear of the frame, and the auxiliary wheels is disposed at a front or a rear of the frame opposite the primary wheel.

21. A device in accordance with claim 20, wherein the auxiliary wheel has an axis of rotation located at a height above the upper surface of the platform.

22. A device in accordance with claim 20, wherein the auxiliary wheel is a universal wheel rotatable about a secondary axis of rotation which is oriented generally horizontally.

23. A device in accordance with claim 1, further comprising:

a) an electrical generator, operatively engaging at least one of the primary wheels, capable of generating electricity when the at least one primary wheel turns; and b) a light, electrically coupled to the electrical generator.

24. A device in accordance with claim 1, wherein the primary wheels are removably coupled to the frame by a hand actuated fastener.

25. A wheeled skate device comprising:

a) a frame configured to be movably disposed over a support surface, and having a platform with an upper surface configured to receive a foot of a user thereon;

b) a pair of primary wheels, rotatably coupled to the frame, configured to roll on the support surface;

c) the pair of primary wheels having a primary axis of rotation located at a height above the upper surface of the platform;

d) an auxiliary wheel, rotatably coupled to the frame, configured to roll on the support surface;

e) a pair of lateral attachment supports, coupled to opposite lateral sides of the frame, the pair of lateral attachment supports being separate and independent with respect to one another, the pair of primary wheels being rotatably attached to the pair of lateral attachment supports; and f) compressible members, each disposed between the pair of lateral attachment supports and the frame, to allow the pair of lateral attachment supports, and thus the pair of primary wheels, to pivot independently with respect to the frame.

* * * * *